US009609923B2

(12) United States Patent
Bernon

(10) Patent No.: US 9,609,923 B2
(45) Date of Patent: Apr. 4, 2017

(54) COLOR CHANGING MULTIPLE STONE SETTING

(75) Inventor: Gérard Bernon, Arles (FR)

(73) Assignee: JACOB'S JEWELRY CO., LTD., Bangrak (TH)

( * ) Notice: Subject to any disclaimer, the term of this patent is extended or adjusted under 35 U.S.C. 154(b) by 25 days.

(21) Appl. No.: 13/980,933

(22) PCT Filed: Jan. 25, 2011

(86) PCT No.: PCT/EP2011/050947
§ 371 (c)(1),
(2), (4) Date: Aug. 26, 2013

(87) PCT Pub. No.: WO2012/100817
PCT Pub. Date: Aug. 2, 2012

(65) Prior Publication Data
US 2013/0327089 A1 Dec. 12, 2013

(51) Int. Cl.
*A44C 17/02* (2006.01)
*A44C 17/04* (2006.01)

(52) U.S. Cl.
CPC ..... *A44C 17/02* (2013.01); *A44C 17/046* (2013.01)

(58) Field of Classification Search
CPC .... A44C 17/02; A44C 17/046; A44C 17/0258
USPC ..... D11/91, 92; 63/26, 28
See application file for complete search history.

(56) References Cited

U.S. PATENT DOCUMENTS

| | | | | |
|---|---|---|---|---|
| 521,370 | A * | 6/1894 | Hensel | 428/28 |
| 4,936,115 | A * | 6/1990 | Mesica | 63/26 |
| 6,012,302 | A | 1/2000 | Hurwitz et al. | |
| 7,127,916 | B2 | 10/2006 | Ruth | |
| 2007/0234758 | A1 | 10/2007 | Mehta | |
| 2009/0071192 | A1 | 3/2009 | Bauman | |

FOREIGN PATENT DOCUMENTS

AT 10093 U1 * 9/2008 ..... A44C 17/02

OTHER PUBLICATIONS

International Search Report, dated Oct. 4, 2011, from corresponding PCT application.

* cited by examiner

*Primary Examiner* — Jack W Lavinder
(74) *Attorney, Agent, or Firm* — Ostrolenk Faber LLP

(57) ABSTRACT

A multiple stone setting (20) includes a first, second and third stone (21, 22, 23) each set on respective plane surfaces (31, 32, 33) of a base (35) such that the second (22) stone is positioned perpendicular to the first stone (21) and such that the third stone (23) is positioned perpendicular to the first stone (21) and to the second stone (22), each stone (21, 22, 23) displaying a different color. As the viewing angle of an observer changes, each of the colors changes to a different color. A two-color changing multiple stone setting (70) is also disclosed. By providing multiple stone settings (20) and (70) three- and two-color changing surfaces may be created, respectively, that acquire an autonomous entity with changing viewing angles. Stone settings (20) and (70) may be useful to create articles of jewelry as well as to enhance objects and designs of various natures.

25 Claims, 8 Drawing Sheets

COLOR CHANGING MULTIPLE STONE SETTING

TECHNICAL FIELD OF THE INVENTION

The present invention relates to jewelry and, more particularly, to a color changing multiple stone setting.

BACKGROUND OF THE INVENTION

It is an ongoing challenge in the jewelry industry to design and create jewelry with enhanced appearance. Gemstone arrangements are often created to enhance the appearance of the individual gems, for example, by altering their visual characteristics. This is often done by mounting complementary stones relative to a center stone. Such complementary stones may be arranged to reflect or refract light in a manner that further enhances the natural beauty of the center stone, as shown, for example, in U.S. Pat. No. 7,127,916 B2 and U.S. Patent Application No. 2004/0237585 A1.

In recent years, color changing jewelry has become quite popular. Currently, color changing jewelry is often created by using color changing gemstones, such as alexandrite, iolite, sapphire or garnet, that exhibit color change when viewed in different lighting conditions, such as incandescent light, fluorescent light, sunny outdoors, rainy outdoors or shady outdoors. Such gemstones are rare and expensive. To lower the cost of such color changing jewelry, synthetic stones, such as synthetic corundum marketed as "Alexandrium" or the true synthetic alexandrite may be created in a lab. However, each of those stones changes color individually, which may limit their application in multiple stone settings.

Another method for creating color changing jewelry is to apply a coating to crystals, for example, Swarovski crystals are known to be finished with a coating called "vitrail" to change from green to gold to magenta to blue depending on the viewing angle of an observer. However, especially when using natural stones, it may not be desirable to apply a coating that hides the natural beauty of the stone. Additionally, the application of a coating is a relatively cost intensive extra step.

What is needed in the art is a setting for stone arrangements that change color when the viewing angle is changed independently from the lighting conditions and without application of a topcoat.

SUMMARY OF THE INVENTION

It is an object of the present invention to provide a multiple stone setting that enables the change of the esthetic appearance of a stone arrangement in a simpler manner.

It is an object of the present invention to provide a multiple stone setting that enables the change of the esthetic appearance of an entire stone arrangement with the viewing angle of an observer.

It is an object of the present invention to enable the creation of articles of jewelry that generate an enhanced feeling of exchange and playfulness through color change during movement of either an observer or the articles of jewelry themselves.

Briefly described, the present invention provides a color changing jewelry having a multiple stone setting that enables the formation of a three-color changing surface. As an embodiment, three stones that may be, for example, typical white round center diamonds, are set on plane surfaces of a base at a 90° angle between them. The respective center axis and also the respective girdles of all three stones are oriented perpendicular relative to each other when the stones are set with the tables facing outwards. As a result, each of the stones displays a different color due to the angle of inclination of the stones. Contrary to the known prior art, this display of various colors is independent from the surrounding lighting conditions.

In an alternate embodiment in accordance with the present invention, a multiple stone setting enables the formation of a two-color changing surface. Here, two stones are set on plane surfaces of a base at a 90° angle between them. The respective center axis and also the respective tables of the two stones, respectively, are oriented perpendicular relative to each other when the stones are set with the tables facing outwards. As a result, each of the stones displays a different color due to the angle of inclination of the stones. Contrary to the known prior art, this display of various colors is also independent from the surrounding lighting conditions.

The stones of both multiple stone settings may be set on a base that is made as a single piece or that is formed by joining several separate plane surfaces. Furthermore, the stones of both multiple stone settings may preferably be set with prongs or a combination of prongs and bezels to most effectively display the stones.

Both color changing multiple stone settings may in accordance with embodiments of the present invention be utilized to manufacture articles of jewelry or to enhance objects and designs of various nature. By combining a plurality of the two-color change multiple stone settings or by combining a plurality of the three-color change multiple stone setting or even by combining a plurality of two-color and three-color change multiple stone settings, a variety of color changing surfaces may be created. These surfaces are not still surfaces but rather surfaces that acquire an autonomous entity through the movement of an observer or through the movement of an object made from the multiple stone settings themselves. As a result, the esthetic appearance of the multiple stone settings in accordance with the present invention changes simply with a viewing angle.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates exemplary embodiments of the invention, in one form, and such exemplification is not to be construed as limiting the scope of the invention in any manner.

DETAILED DESCRIPTION OF THE INVENTION

The present invention will be described with reference to certain embodiments and with reference to the above mentioned drawings, but such description is by way of example only and the invention is not limited thereto but only by the appended claims.

Figure 1:
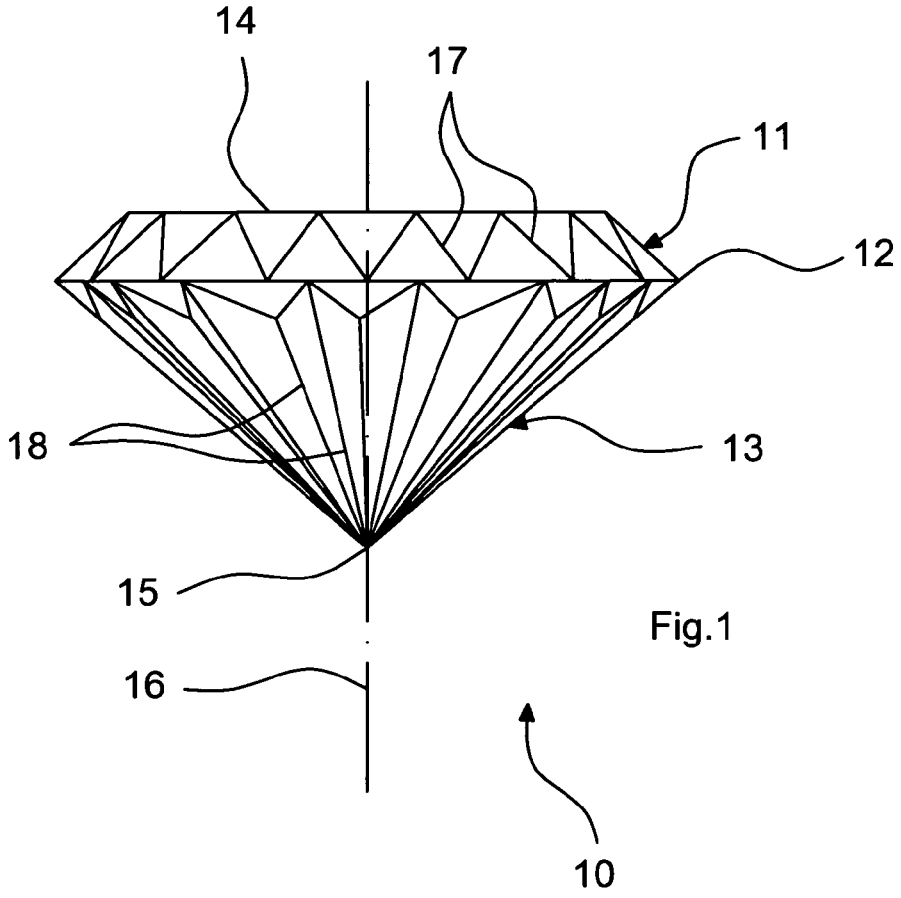
FIG. 1 is a schematic front view of a typical stone in accordance with an embodiment of the present invention.

Referring to FIG. 1, a typical stone 10 that may be utilized in accordance with the present invention is illustrated. Stone 10 is shown as round center diamond including a crown 11, a girdle 12, a pavilion 13, a table 14, and a culet 15, as is well known. The crown 11 is positioned above the girdle 12, while the pavilion 13 is positioned below the girdle 12. Stone 10 extends longitudinally along a center axis 16 from table 14 to culet 15. Stone 10 is shown to extend radially outward from center axis 16. Table 14 may be flat. The crown 11 may include upper facets 17 and pavilion 13 may include lower facets 18. Stone 10 may be a diamond or other precious or semi-precious gemstone as well as a synthetic stone. Stone 10 may preferably be a white diamond. It may further be possible to utilize stones 10 with color variances. While stone 10 is illustrated to have a round shape, it may not be limited to that shape. Other shapes, such as a square, rectangular, oval or cushion shape, may be used.

Figure 2:
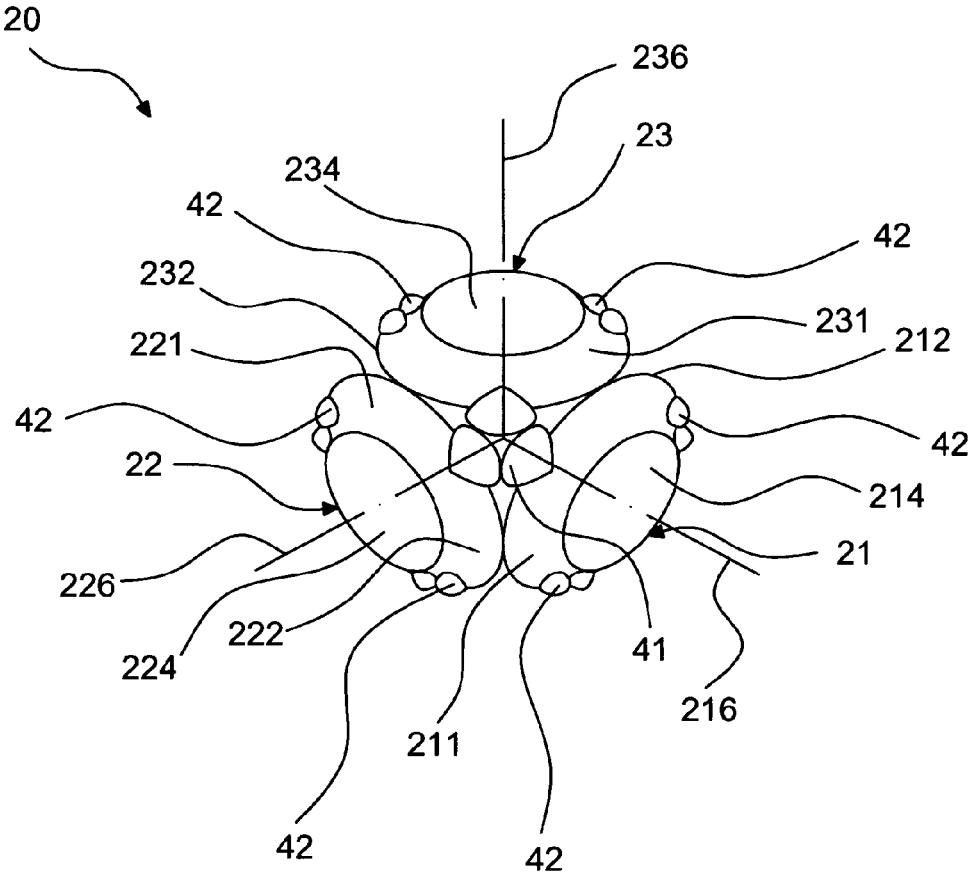
FIG. 2 is a perspective view of a three-color changing stone setting, in accordance with a first embodiment of the present invention.
Figure 3:
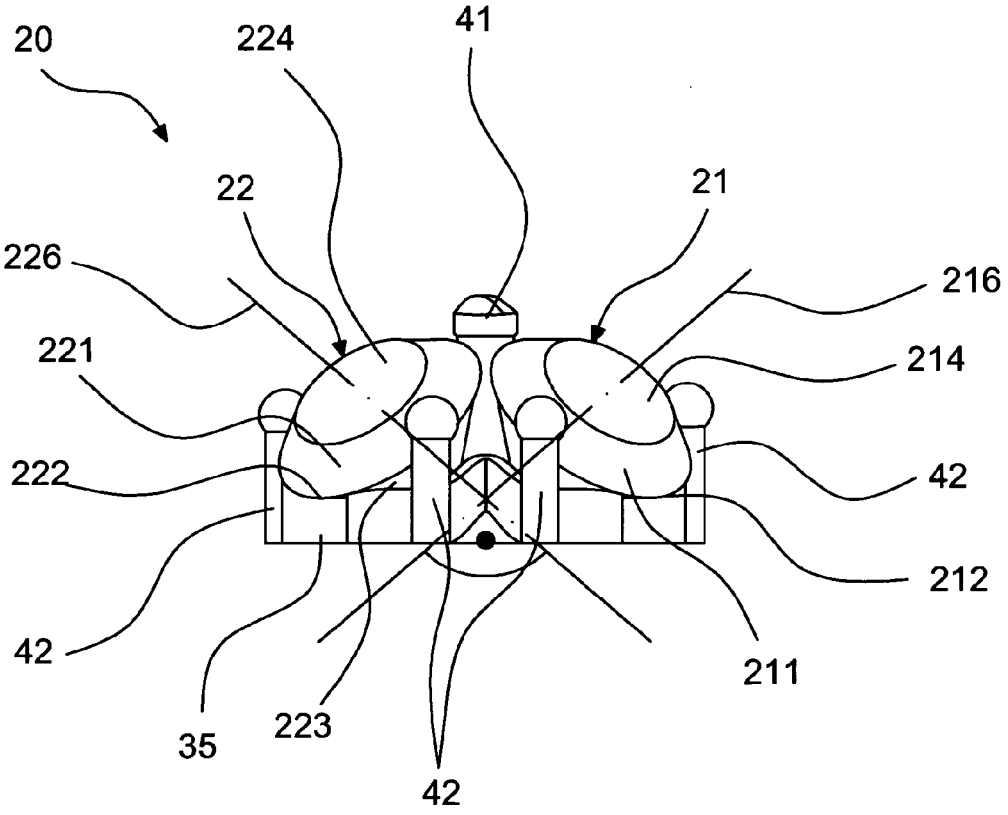
FIG. 3 is a front view of the three-color changing stone setting, in accordance with the first embodiment of the present invention.
Figure 4:
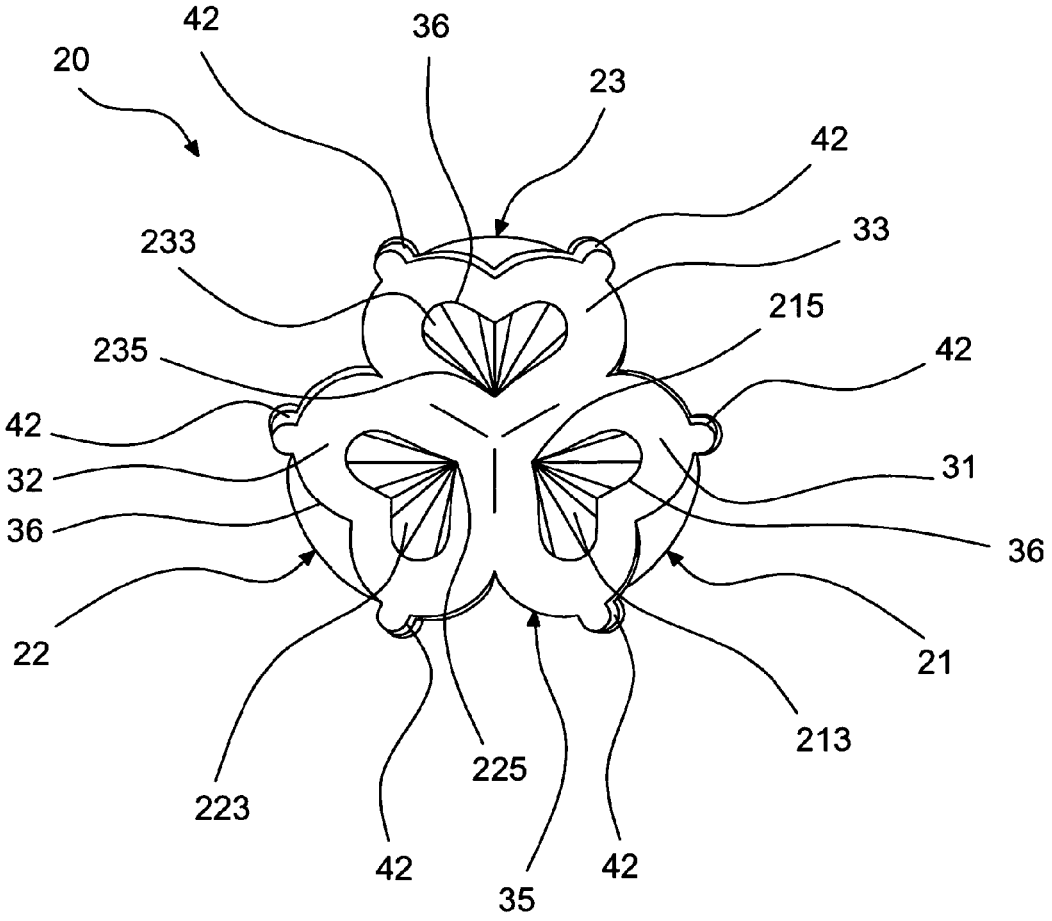
FIG. 4 is a bottom view of the three-color changing stone setting, in accordance with the first embodiment of the present invention.

Referring to FIGS. 2 through 4, a multiple stone setting 20 that enables a three-color change is illustrated in accordance with a first embodiment of the present invention. Multiple stone setting 20 includes three stones 21, 22, and 23, which may be identical with stone 10, as illustrated in FIG. 1. Accordingly, stone 21 may include a crown 211, a girdle 212, a pavilion 213, a table 214, and a culet 215, and may extend along a center axis 216. Accordingly, stone 22 may include a crown 221, a girdle 222, a pavilion 223, a table 224, and a culet 225, and may extend along a center axis 226. Accordingly, stone 23 may include a crown 231, a girdle 232, a pavilion 233, a table 234, and a culet 235, and may extend along a center axis 236.

Each of the three stones 21, 22, and 23 is set on a plane surface 31, 32, and 33, respectively, with the tables 214, 224, and 234, respectively, facing outwards. The plane surfaces 31, 32, and 33 may be formed as a single piece, base 35, as shown in FIG. 4, and may be positioned relative to each other such that the stones 21, 22, and 23 may be set at a 90° angle between them, as shown in FIG. 3. Alternatively, plane surfaces 31, 32, and 33 may be separate pieces that may be joined to form base 35. As can be seen in FIG. 3, girdle 212 of the stone 21 is positioned perpendicular to girdle 222 of the stone 22 and accordingly center axis 216 of stone 21 is positioned perpendicular to center axis 226 of stone 22. As can be derived from FIG. 2, center axis 236 of stone 23 is positioned perpendicular to center axis 216 of stone 21 and to center axis 226 of stone 22. As illustrated in FIG. 4, plane surfaces 31, 32, and 33 may include apertures 36 that on one hand may save material and on the other hand may be used to receive and position culets 215, 225, and 235 of stones 21, 22, and 23, respectively. Alternatively, solid plane surfaces 31, 32, and 33 may be used. Plane surfaces 31, 32, and 33 and, therefore, base 35 may be made from gold, silver or any other suitable metal.

Referring again to FIG. 3, stones 21, 22, and 23 may be secured in place on the plane surfaces 31, 32, and 33, respectively, by a plurality of prongs, center prong 41 and circumferential prongs 42. Center prong 41 extends vertically upward from the center 34 of base 35 and includes at its topmost end bearings for engaging the girdles 212, 222, and 232 of stones 21, 22, and 23, respectively. Alternatively, instead of using a single center prong 41, three separate prongs (not shown) may be utilized, each including a bearing for engaging one of the stones 21, 22 or 23. In addition to being secured by center prong 41, each of the stones 21, 22, and 23 is secured further by at least two circumferential prongs 42. Each circumferential prong 42 extends vertically upward from the circumference of base 35 and includes at its topmost end a bearing for engaging the girdle 212, 222 or 232 of one of the stones 21, 22 or 23, respectively. When set, the girdles 212, 222, and 232 of stone 21, 22, and 23, respectively, are oriented at a 45° angle in reference to the vertical extending prongs 41 and 42, as shown in FIG. 3. Setting of stones 21, 22, and 23 at a 90° angle with respect to each other may not be limited to using prongs 41 and 42 in connection with base 35. Other setting techniques, such as channel setting, nick setting, pave setting, or burnishing may be useful in some applications.

When stone setting 20 is completed, each of the stones 21, 22, and 23 may display a different color due to the angle of inclination of the stones 21, 22, and 23. Thus, stone setting 20 displays three different colors concurrently. Furthermore, as the viewing angle changes, each of the displayed colors changes to a different color independent from the lighting conditions. Colors ranging from blue imitating sapphires to white imitating diamonds may be displayed.

Figure 5:
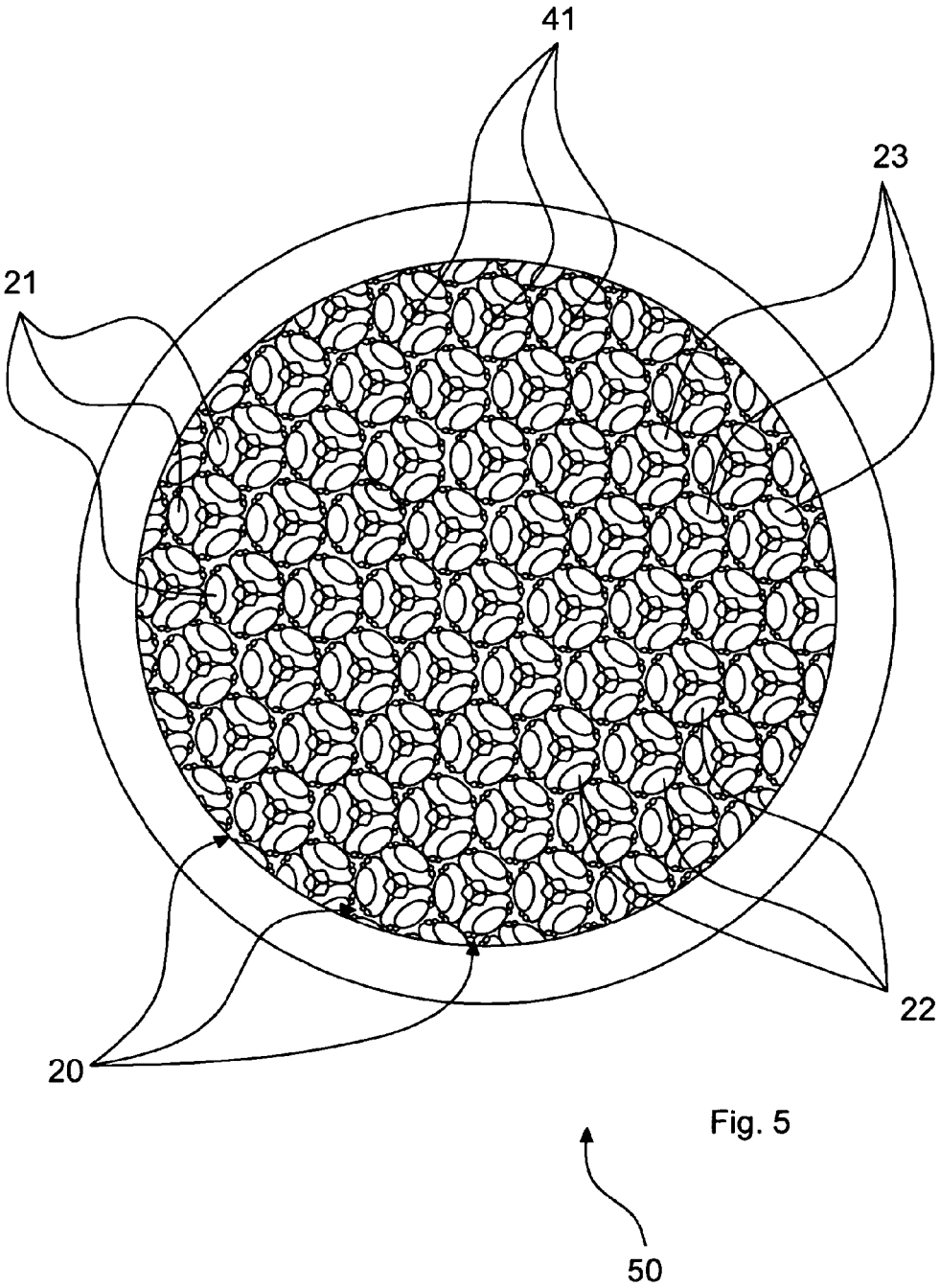
FIG. 5 is an exemplary utilization of the three-color changing stone setting, in accordance with the first embodiment of the present invention.

Referring now to FIG. 5, an exemplary utilization of the three-color changing stone setting 20 in accordance with one aspect of the present invention is illustrated. A plurality of stone settings 20 are shown joined in a circular jewel 50, such as a button, pin, ornament, brooch, or pendant. Alternatively, plurality of stone settings 20 may be joined in basically any shape desirable. Stone settings 20 may be arranged to form a color changing geometric pattern or to display, for example, a logo, a name or initials with changing viewing angles. In an alternate embodiment, two or more groups of joined stone settings 20 may be formed and a jewel may be created from these groups by tilting these groups of stone settings 20 relative to each other.

Figure 6:
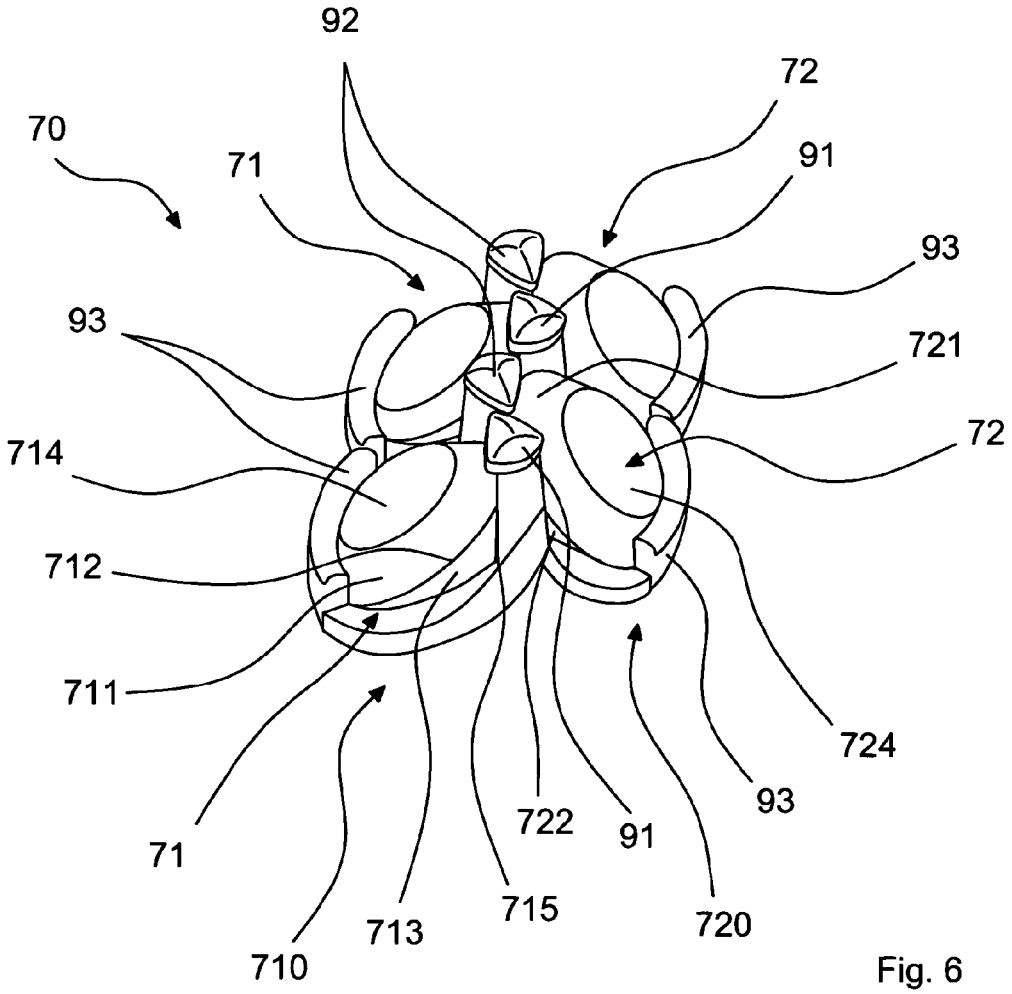
FIG. 6 is a perspective view of a two-color changing stone setting, in accordance with a second embodiment of the present invention.
Figure 7:
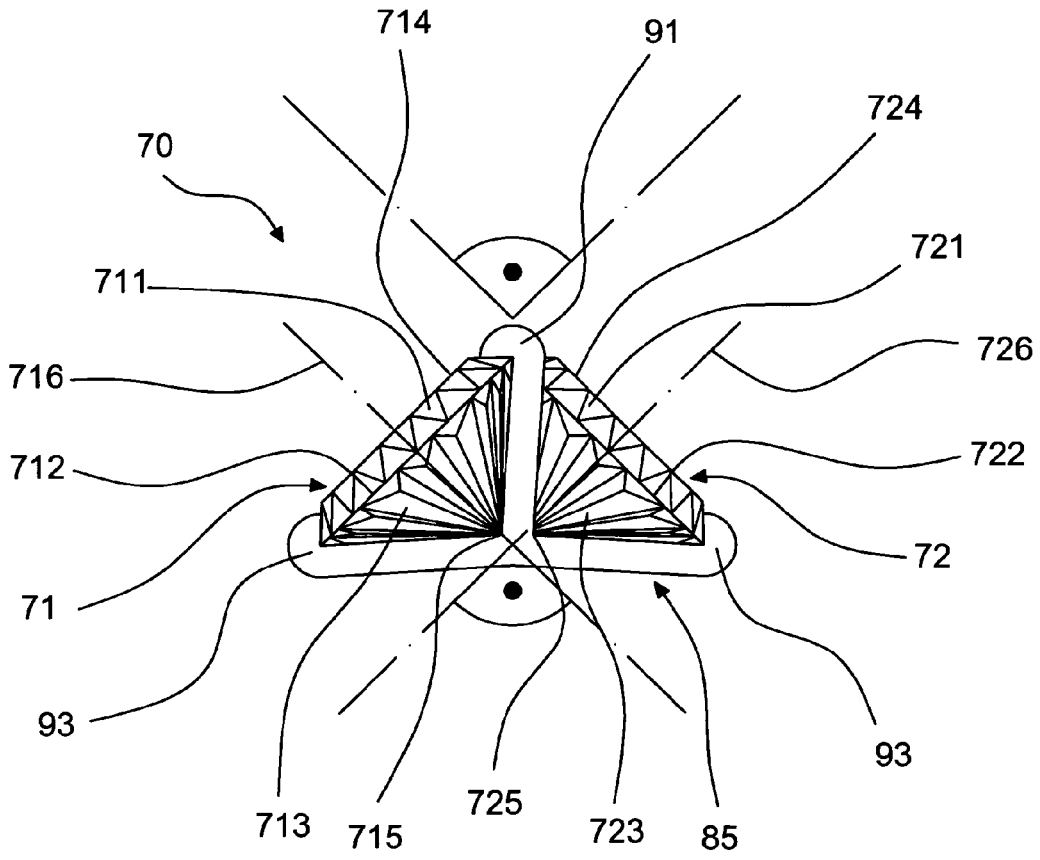
FIG. 7 is a front view of the two-color changing stone setting, in accordance with the second embodiment of the present invention.
Figure 8:
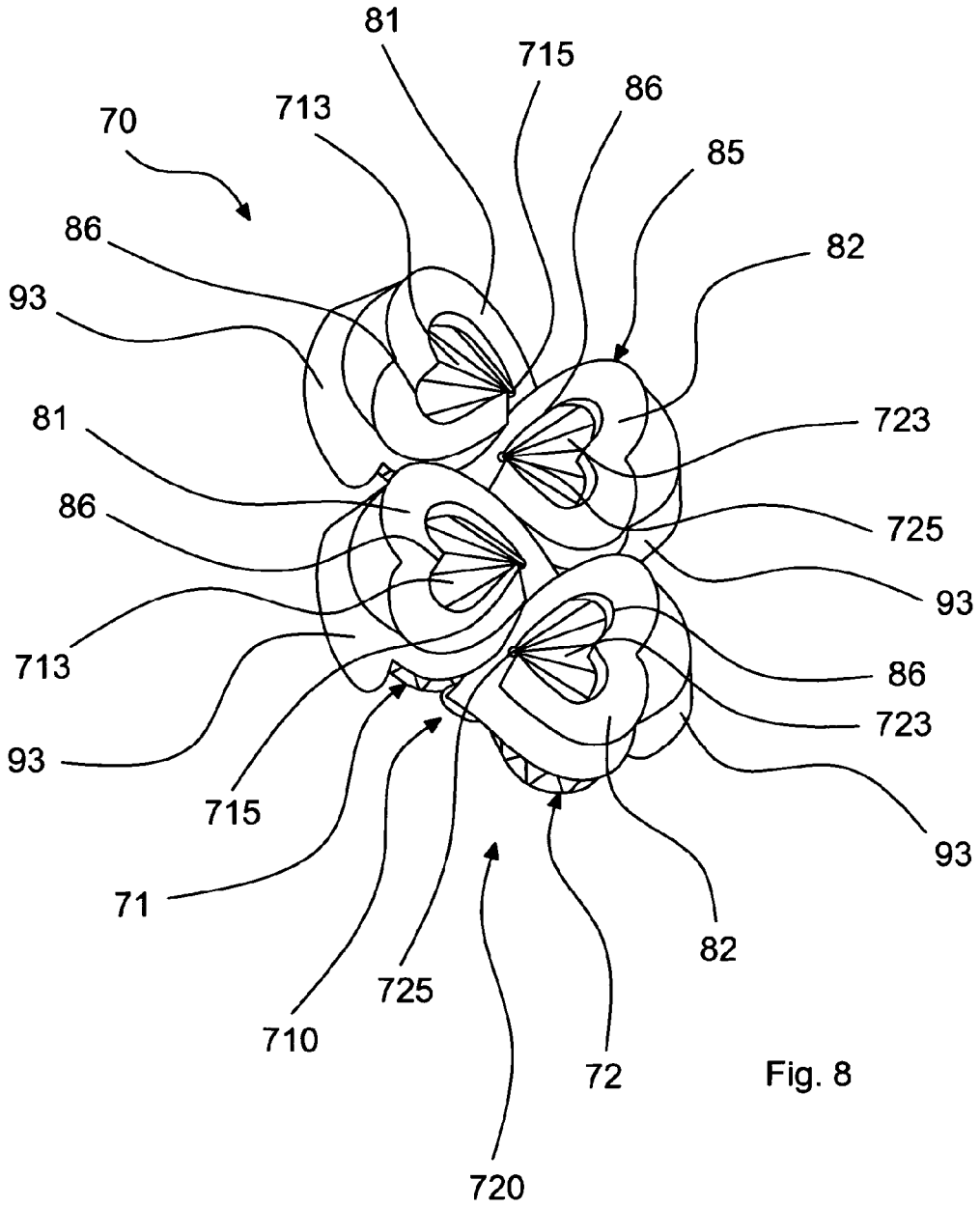
FIG. 8 is a bottom view of the two-color changing stone setting, in accordance with the second embodiment of the present invention.

Referring now to FIGS. 6 through 8, a multiple stone setting 70 that enables a two-color change is illustrated in accordance with a second embodiment of the present invention. Multiple stone setting 70 includes at least two stones 71 and 72, which may be identical with stone 10, illustrated in FIG. 1. Accordingly, stone 71 may include a crown 711, a girdle 712, a pavilion 713, a table 714, and a culet 715, and may extend along a center axis 716. Accordingly, stone 72 may include a crown 721, a girdle 722, a pavilion 723, a table 724, and a culet 725, and may extend along a center axis 726.

Each of the two stones 71 and 72 is set on a plane surface 81 and 82, respectively, with the tables 714 and 724, respectively, facing outwards. The plane surfaces 81 and 82 may be formed as a single piece, base 85, as shown in FIG. 8 and may be positioned relative to each other such that the stones 71 and 72 may be set at a 90° angle between them, as shown in FIG. 7. Alternatively, plane surfaces 81 and 82 may be separate pieces that may be joined to form base 85. As can be seen in FIG. 7, table 714 of the stone 71 is positioned perpendicular to table 724 of the stone 72 and accordingly center axis 716 of stone 71 is positioned perpendicular to center axis 726 of stone 72. As illustrated in FIG. 8, plane surfaces 81 and 82 may include apertures 86 that on one hand may save material and on the other hand may be used to receive and position culets 715 and 725 of stones 71 and 72, respectively. Alternatively, solid plane surfaces 81 and 82 may be used. Plane surfaces 81 and 82 and, therefore, base 85 may be made from gold, silver or any other suitable metal.

Referring again to FIGS. 6 and 7, stones 71 and 72 may be secured in place on the plane surfaces 81 and 82, respectively, by two center prongs 91 and 92 positioned proximate the middle of base 85 and two partial bezels 93 formed at opposite edges of base 85. Bezels 93 may be shaped like a wall including at the top end a bearing for engaging girdles 712 and 722. Each of the partial bezels 93 may be replaced by at least two prongs (not shown). Center prong 91 extends vertically upward from base 85 and includes at its topmost end a bearing for engaging the girdle 712 of stone 71. Center prong 92 extends vertically upward from base 85 at a distance from center prong 91 and includes at its topmost end a bearing for engaging the girdle 722 of stone 72. In addition to being secured by center prongs 91 and 92, each of the stones 71 and 72 may be further secured by partial bezel 93. When set, the girdles 712 and 722 of stone 71 and 72, respectively, are oriented at a 45° angle in reference to the vertical extending prongs 91 and 92, as shown in FIG. 7. Setting of stones 71 and 72 at a 90° angle with respect to each other may not be limited to using prongs 91 and 92 and partial bezels 93 in connection with base 85. Other setting techniques, such as prong setting, channel setting, nick setting, pave setting, or burnishing may be useful in some applications.

When stone setting 70 is completed, each of the stones 71 and 72 may display a different color due to the angle of inclination of the stones 71 and 72. Thus, stone setting 70 displays two different colors concurrently. Furthermore, as the viewing angle changes, each of the displayed colors changes to a different color independently from the lighting conditions. Colors ranging from blue imitating sapphires to white imitating diamonds may be displayed.

As illustrated in FIGS. 6 and 8, more than one pair of stones 71 and 72 may be used to form stone setting 70. In this case, a plurality of stones 71 may be placed in a row 710 and a plurality of stones 72 may be placed in a row 720. Stones 72 may be staggered relative to stones 71. The staggered rows 710 and 720 may include any desired number of stones 71 or stones 72, respectively. Also, any desired number of alternating rows 710 and 720 may be utilized. The stones 71 arranged in row 710 may display a first color while the stones arranged in row 720 may display a second color that is different from the first color. When the viewing angle of an observer is changed or the wearer of the stone setting 70 moves, each of the currently displayed colors changes to a different color. Furthermore, stone setting 70 may be utilized similar to stone setting 20 the create jewels as described above in connection with FIG. 5.

By providing multiple stone settings 20 and 70 in accordance with exemplary embodiments of the present invention, three- and two-color changing surfaces may be created, respectively. The color and, therefore, the esthetic appearance of multiple stone settings 20 and 70 changes with the viewing angle of an observer due to the 90° angle of inclination of the set stones 21, 22, and 23 as well as 71 and 72, respectively. Accordingly, stone settings 20 and 70 provide not still surfaces but rather surfaces that acquire an autonomous entity by the movement of an observer or of the multiple stone settings 20 or 70 themselves. Stone settings 20 and 70 may be useful to create articles of jewelry as well as to enhance objects and designs of various natures.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

The invention claimed is:

1. A multiple stone setting, comprising:

a first stone set on a first plane surface of a base displaying a first color;

a second stone set on a second plane surface of said base such that said second stone is positioned perpendicular to said first stone displaying a second color that differs from said first color; and a third stone set on a third plane surface of said base such that said third stone is positioned perpendicular to said first stone and to said second stone displaying a third color that differs from said first and from said second color;

wherein each of said first, second and third stones includes a table facing outwards; and wherein each of said first, second, and third color changes to a different color as a viewing angle changes.

2. The multiple stone setting according to claim 1, wherein said first stone extends longitudinally along a first center axis;

wherein said second stone extends longitudinally along a second center axis;

wherein said third stone extends longitudinally along a third center axis; and wherein said first center axis is perpendicular to said second center axis and wherein said third center axis is perpendicular to said first center axis and to said second center axis.

3. The multiple stone setting according to claim 2, wherein said first, second and third plane surfaces are separate pieces that are joined to form said base.

4. The multiple stone setting according to claim 2, wherein said base is formed as a single piece.

5. The multiple stone setting according to claim 2, further including:

a center prong and a plurality of circumferential prongs;

wherein said center prong extends vertically upward from a center of said base and includes bearings for engaging said first, second and third stones;

wherein each of said circumferential prongs extends vertically upward from a circumference of said base and includes a bearing for engaging one of said first, second and third stones; and wherein each of said first, second and third stones is secured by said center prong and at least two of said circumferential prongs.

6. The multiple stone setting according to claim 1, wherein said first, second and third plane surfaces are separate pieces that are joined to form said base.

7. The multiple stone setting according to claim 1, wherein said base is formed as a single piece.

8. The multiple stone setting according to claim 1, wherein said first, second and third plane surfaces include apertures (36).

9. The multiple stone setting according to claim 8, wherein said apertures assist positioning of said first, second and third stones.

10. The multiple stone setting according to claim 1, further including:

a center prong and a plurality of circumferential prongs;

wherein said center prong extends vertically upward from a center of said base and includes bearings for engaging said first, second and third stones;

wherein each of said circumferential prongs extends vertically upward from a circumference of said base and includes a bearing for engaging one of said first, second and third stones; and wherein each of said first, second and third stones is secured by said center prong and at least two of said circumferential prongs.

11. The multiple stone setting according to claim 1, wherein said first, second and third stones are round center diamonds.

12. The multiple stone setting according to claim 1, wherein said first, second and third stones are white diamonds.

13. The multiple stone setting according to claim 1, wherein said first, second and third colors range from blue imitating sapphires to white imitating diamonds.

14. The multiple stone setting according to claim 1, wherein an article of jewelry is formed using one or more of said multiple stone settings.

15. A combination of several multiple stone settings as claimed in claim 1, said multiple stone settings being joined to each other to form a surface.

16. A multiple stone setting, comprising:

a base;

a plurality of first stones placed in a first row, wherein each first stone being set on a first plane surface of said base, said first stones displaying a first color; and a plurality of second stones set in a second row, each second stone being set on a second plane surface of said base which is contiguous with said first surface, such that said plurality of second stones is positioned substantially perpendicularly to said plurality of first stones, said second stones displaying a second color that differs from said first color;

wherein each of said first and second stones includes a table facing outwards;

wherein said first row displays said first color;

wherein said second row displays said second color that differs from said first color; and wherein each of said first stones and each of said second stones has a respective pavilion and a respective girdle, and wherein said respective girdles and said respective pavilions of the first stones are located in close proximity to the respective girdles and respective pavilions of the second stones, thereby substantially covering and obscuring the base of the setting where the first and second stones are in close proximity to each other, whereby a visible overall color perception of said setting changes as a viewing angle of said setting gradually changes, varying from one to the other of said first and second colors, owing to the first stones gradually obscuring the second stones and the second stones gradually obscuring the first stones, as the viewing angle of said setting is gradually changed as the setting is being observed, while rotating said setting around an axis of the setting that passes between the first and second rows of stones.

17. The multiple stone setting according to claim 16, wherein each said first stones extend longitudinally along a respective first center axis and the respective first center axes are parallel to each other;

wherein each said second stones extend longitudinally along a respective second center axis and the respective second axes are parallel to each other; and wherein a first plane containing said respective first center axes is perpendicular to a second plane containing said respective second center axes.

18. The multiple stone setting according to claim 16, wherein said setting includes apertures that assist positioning of said first and second stones.

19. The multiple stone setting according to claim 16, wherein said first stones and said second stones are secured in place with a combination of prongs and partial bezels.

20. The multiple stone setting according to claim 16, wherein a plurality of said first rows and a plurality of said second rows are arranged alternatingly.

21. The multiple stone setting according to claim 16, wherein at least some of said first and second stones are white round center diamonds.

22. The multiple stone setting according to claim 16, in combination with an article of jewelry incorporating at least one of said multiple stone setting.

23. The multiple stone setting according to claim 16, including a plurality of said multiple stone settings to display a color changing logo or name.

24. A combination comprising a plurality of said multiple stone settings as claimed in claim 16, said multiple stone settings being joined to each other to form a contiguous surface substantially covered by said first stones and said second stones.

25. The multiple stone setting according to claim 16, wherein the second stones are set in staggered relationship to said first stones.

* * * * *